US007731519B1

(12) United States Patent
Swenson, Jr.

(10) Patent No.: US 7,731,519 B1
(45) Date of Patent: Jun. 8, 2010

(54) ADAPTABLE UNIVERSAL ELECTRICAL CONNECTOR SYSTEM PARTICULARLY ADAPTED FOR USE IN REPAIR OR REPLACEMENT OF ELECTRICAL COMPONENTS SUCH AS RELAYS, SOLENOIDS AND THE LIKE

(75) Inventor: Roger M. Swenson, Jr., Poplar Bluff, MO (US)

(73) Assignee: Trans-a-Matic, Inc., Poplar Bluff, MO (US)

( * ) Notice: Subject to any disclaimer, the term of this patent is extended or adjusted under 35 U.S.C. 154(b) by 351 days.

(21) Appl. No.: 11/057,847

(22) Filed: Feb. 15, 2005

Related U.S. Application Data

(60) Provisional application No. 60/544,351, filed on Feb. 17, 2004.

(51) Int. Cl.
*H01R 13/627* (2006.01)

(52) U.S. Cl. ..... 439/352; 439/357

(58) Field of Classification Search ..... 439/350, 439/357, 358, 144, 521, 741, 701, 283, 282, 439/352, 595
See application file for complete search history.

(56) References Cited

U.S. PATENT DOCUMENTS 3,643,132 A * 2/1972 Odmark ..... 439/552
3,644,938 A * 2/1972 Slate ..... 439/349
4,088,384 A * 5/1978 Gumb ..... 439/344
4,993,803 A * 2/1991 Suverison et al. ..... 439/283
5,120,237 A * 6/1992 Fussell ..... 439/282
5,161,990 A * 11/1992 Ling et al. ..... 439/174
5,328,390 A * 7/1994 Johnston et al. ..... 439/638
5,338,211 A * 8/1994 Kodama et al. ..... 439/135
5,606,892 A * 3/1997 Hedderly ..... 74/493
5,928,023 A * 7/1999 Buckner et al. ..... 439/373
6,413,123 B1 7/2002 Kirkendall
6,439,923 B1 8/2002 Kirkendall et al.
7,025,636 B2 * 4/2006 Allen ..... 439/357

* cited by examiner

*Primary Examiner*—Briggitte R Hammond
(74) *Attorney, Agent, or Firm*—Bacon & Thomas, PLLC

(57) ABSTRACT

A first electrical connector part is adapted to be universally applicable to a wide variety of many different types of electrical connectors. In order to assure that the electrical connection is maintained, a complemental latching member is provided which is designed to fit a variety of existing electrical connectors. The complemental latching member has an internal cavity and telescopes over the universal electrical connector to coact with a given existing connector having guide keyways or orientation key elements in particular locations and latch the universally applicable electrical part in mating relation with the existing electrical connector. Thus, a discrete complementary part is provided which telescopes over the universal connector part and shields any exposed O.E.M. conductive parts from the environment and has a latching or locking member which shields a locking abutment on the universal part to maintain the electrical connection.

5 Claims, 6 Drawing Sheets

ADAPTABLE UNIVERSAL ELECTRICAL CONNECTOR SYSTEM PARTICULARLY ADAPTED FOR USE IN REPAIR OR REPLACEMENT OF ELECTRICAL COMPONENTS SUCH AS RELAYS, SOLENOIDS AND THE LIKE

REFERENCE TO RELATED APPLICATION

The present application is the subject of provisional application Ser. No. 60/544,351 filed Feb. 17, 2004 entitled "Adaptable Universal Electrical Connector System Particularly Adapted for Use in Repair or Replacement of Electrical Components Such As Relays, Solenoids And The Like" for which priority is claimed.

BACKGROUND AND BRIEF DESCRIPTION OF THE INVENTION

The invention is directed to an adaptable universal electrical connector system particularly adapted for use in repair or replacement and electrical components such as relays, solenoids and the like.

In many situations, electrical connectors (male or female) are designed to fit existing connectors (male or female) extending from various control or controlled devices. In the aftermarket, e.g., the repair and replacement of faulty original O.E.M. parts, it is expensive and difficult to maintain an inventory of duplicate original replacement parts with corresponding factory supplied electrical connector, particularly in situations where slight differences in one part of the electrical connector requires a corresponding change in the replacement part electrical connector.

According to the invention, a first electrical connector part is adapted to be universally applicable to a wide variety of many different types of electrical connectors. In order to assure that the electrical connection is maintained, a variety of second separate electrical connector parts, sometimes called herein complemental latching member, are provided, each of which is designed to fit a variety of existing electrical connectors. The complemental latching member telescopes over the universal electrical connector to coact with a given existing connector having guide keyways or orientation key elements in particular locations and latch the universally applicable electrical part in mating relation with the existing electrical connector. Thus, a discrete complementary part is provided which telescopes over the universal connector part and has a latching or locking member which shields a locking abutment on the universal part to maintain the electrical connection.

The invention features an adaptable universal electric connector system comprising a first electrical connector part which is adapted to be universally applicable to a wide variety of existing electrical connectors having a variety of latch element shapes and locations thereon and a second electrical connector part having a hollow (internal cavity) body member and an end which telescopes over said first electrical connector part and shields the existing electrical connector part from its environment. A latch element having a shape and orientation in particular locations maintains the first electrical connector part in mating relation with the existing electrical connector.

The invention also features the universal electrical connector system defined above wherein the second electrical connecting part has an opening which is shaped to pass the first electrical part, and a stop member or flange on the first electrical connector part for engaging a wall of the second electrical connector part.

The invention also features the universal electrical connector system defined above wherein the flange on the universal electrical connector part and said body member have a combined shape which is the complement of the shape of the hollow body member.

The invention also features an electrical connector system comprising a universal electrical connector part adapted to be universally applicable to a wide variety of many different types of electrical connectors, and a discrete complementary latching member adapted to fit over and maintain the electrical connection, the complementary latching member adapted to telescope over the universal electrical connector to coact with a given existing connector having orientation key elements in selected locations and latch the universal applicable electrical part in mating relation with the existing electrical connector, such that the discrete complementary latching member telescopes over the universal electrical connector part and has a latching or locking wall which coacts with the locking abutment on the universal part to maintain the electrical connection.

The invention also features an adaptable universal electric connector system comprising a first electrical connector part which is adapted to be universally applicable to a wide variety of original equipment manufacture (O.E.M.) electrical connectors having a variety of latch element shapes and locations thereon, a second electrical connector part having a hollow body member and an end which telescopes over the first electrical connector part and shields the O.E.M. electrical connector part, a latch element shape and orientation in particular locations to thereby maintain said first electrical connector part in mating relation with said O.E.M. electrical connector. Moreover, the second connector part has an internal cavity designed to shield the O.E.M. electrical connector, so as to not allow the O.E.M. connector to contact any part of the environment that it is not supposed to, thereby removing the chance of shorting the electrical system. The second connector part has an internal cavity designed to fit O.E.M. electrical connector part and prevent rotation of the connection avoiding possible disconnection of the first connector part by twisting of the union.

DESCRIPTION OF THE DRAWINGS

The above objects and other advantages and features of the invention will become more apparent when considered with the accompanying drawings wherein.

DETAILED DESCRIPTION OF THE INVENTION

While in the following disclosure and description only two wires are showing being connected by the electrical connector system of this invention, it will be appreciated that the invention is applicable to more than two wires. Male and female parts are interchangeable.

Figure 1:
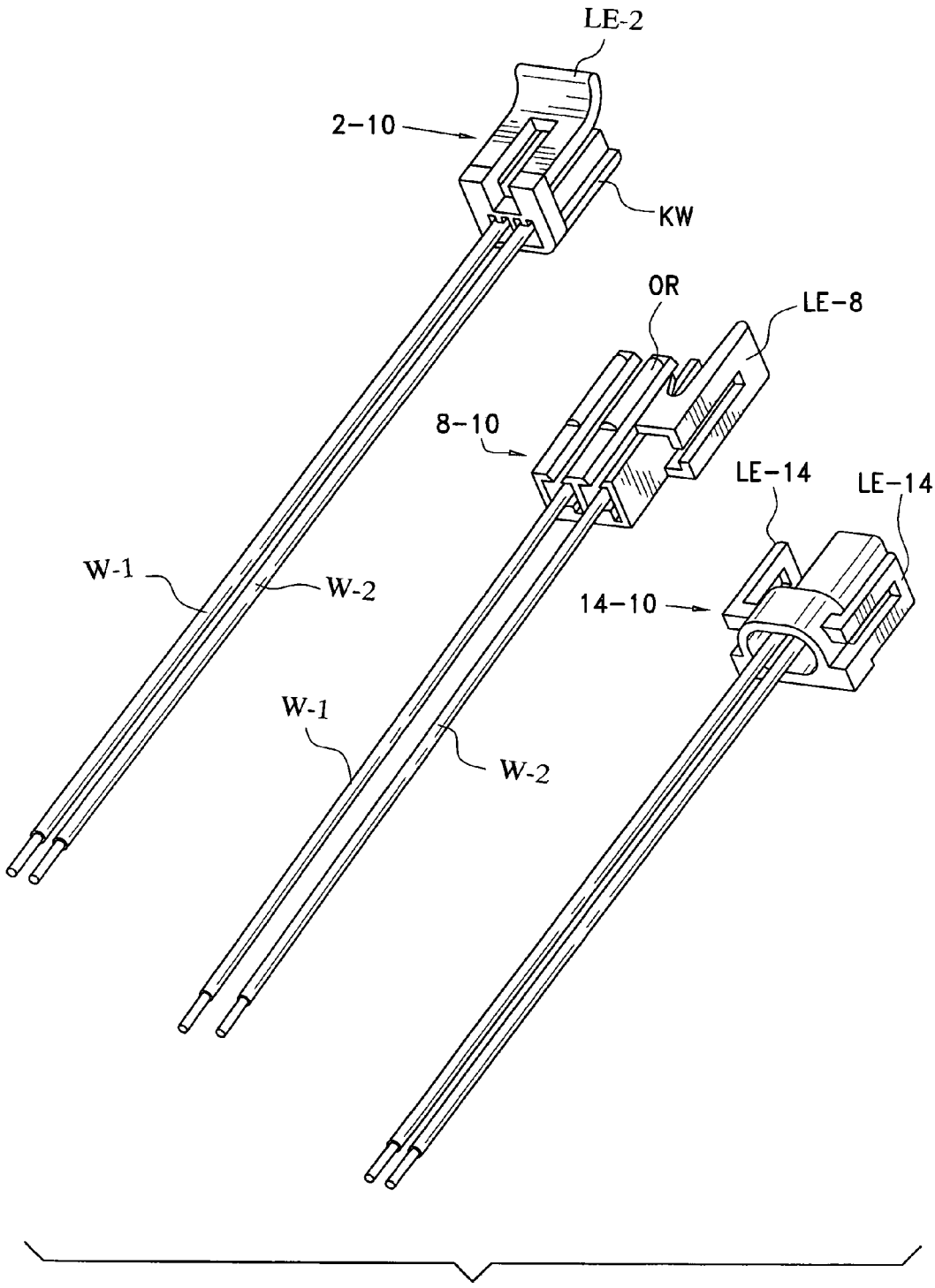
FIG. 1 (PRIOR ART)
FIG. 1 is an isometric view from above of three separate exemplary prior art electrical connector parts (O.E.M.) to which the invention is applicable.

FIG. 1 shows three separate prior art female connector elements or parts 2-10, 8-10, 14-10, each of which has discrete structural features such as latch elements LE, keyways KW, orientation ribs or guides OR to assure proper electrical connections are made. As noted earlier, it is expensive and wasteful to maintain an inventory of O.E.M. electrical connectors. The present invention solves this problem by providing a two-part connector system: a first, universal part or portion, and a second complemental portion which is adapted to complement the existing prior art orientation, keyways, guide ribs, etc.

Figures 2, 3, 4:
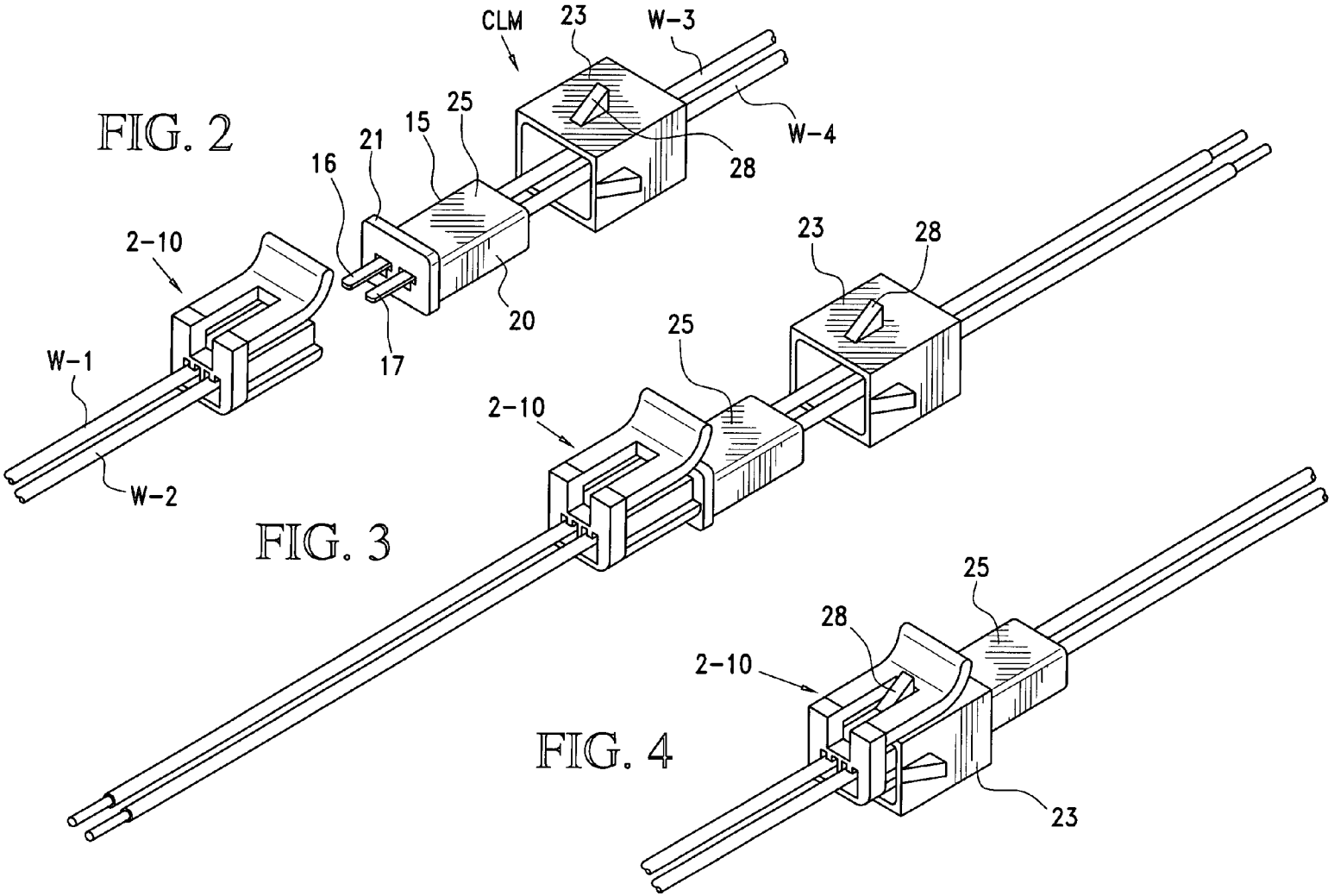
FIG. 2 is an exploded view of a first embodiment of the invention.
FIG. 3 is an exploded view of the first embodiment of the invention showing part of the universal connector element or component in position.
FIG. 4 shows the first embodiment in its assembled state.
Figures 8, 9, 10:
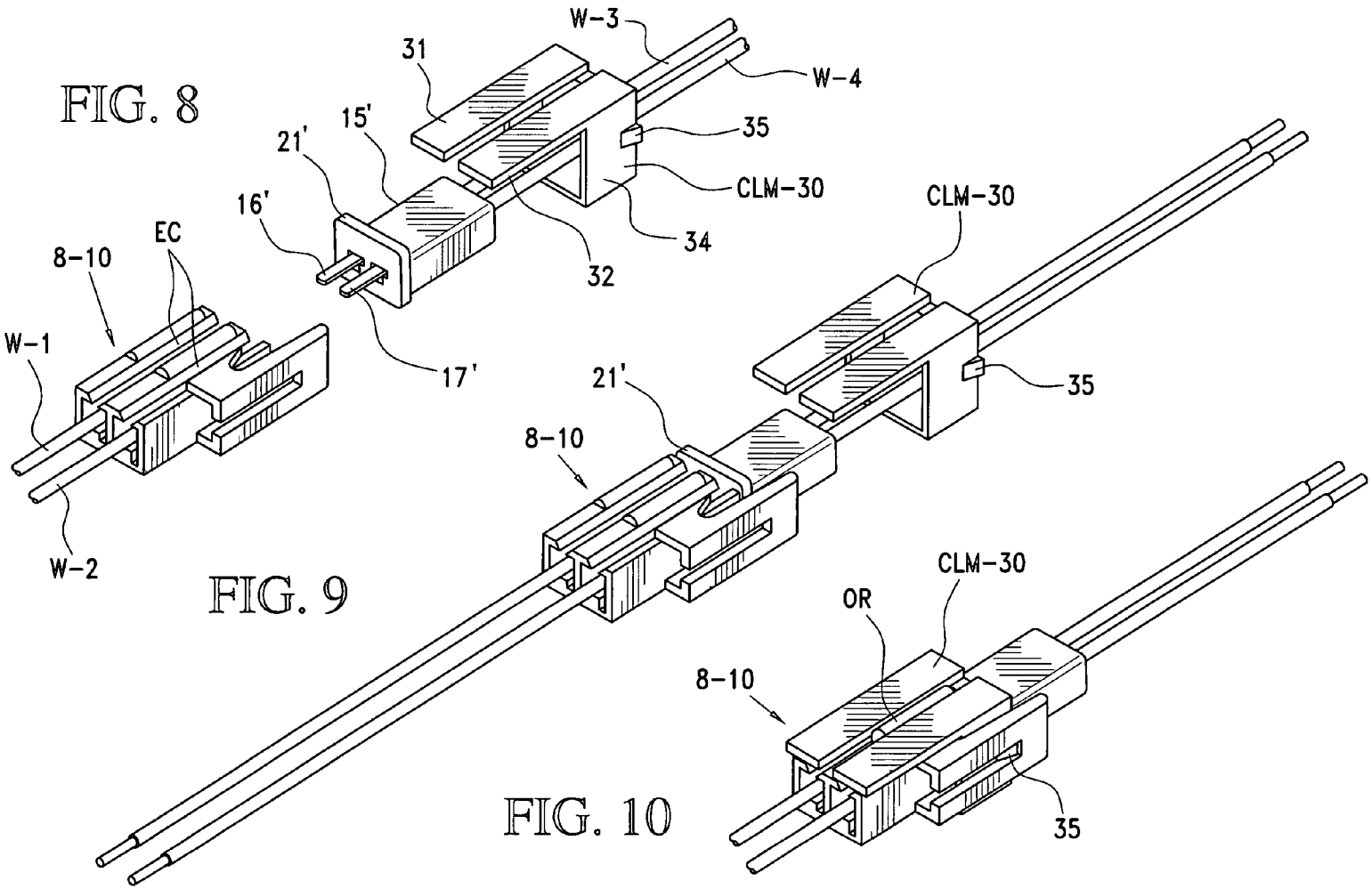
FIG. 8 is an exploded view of a second embodiment of the invention.
FIG. 9 is an exploded view of the second embodiment of the invention showing the universal electrical connector in position.
FIG. 10 is a view showing the second embodiment of the invention in an assembled operative state.
Figure 11:
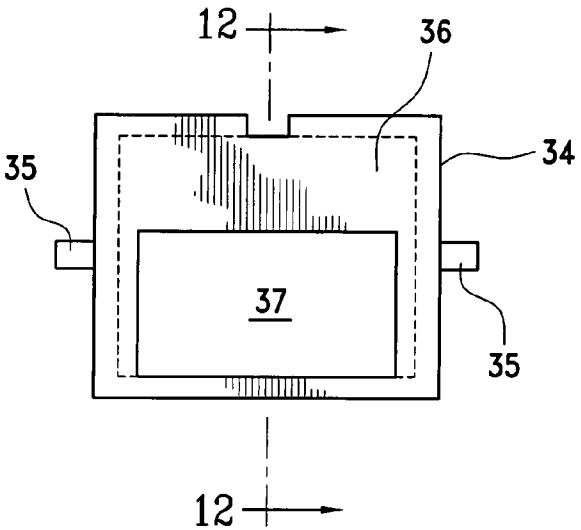
FIGS. 11, 12 and 13 are end, sectional and top views of the complemental latching member in this embodiment.
Figure 14:
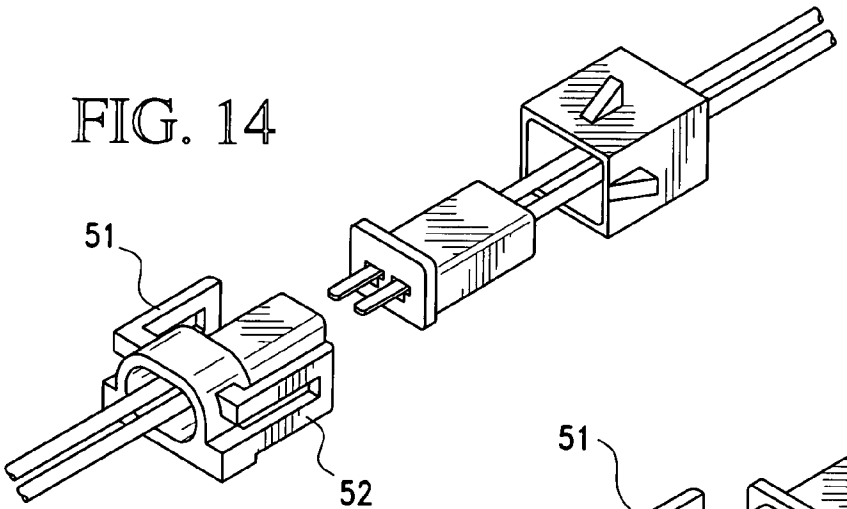
FIG. 14 is an exploded view of a third embodiment of the invention.

Referring initially to FIGS. 2, 8 and 14, the O.E.M. electrical connection components labeled 2-10, 8-10, and 14-10 are existing or prior art electrical connector components shown in FIG. 1. While the connector components 2-10, 8-10 and 14-10 are all female connectors, in which wires W-1 and W-2 are electrically connected to female socket elements (not shown) in the connectors 2-10, 8-10, 14-10, it will be appreciated that they may be male connector socket elements. The connector 2-10 generally has a spring latch element or locking clip LE-2 which will be described more fully hereafter. In addition, connector 2-10 may have one or more orientation keys or ribs OR-2.

A universal connector element 15 is shown as having two male prong connectors 16, 17 which are electrically secured by integral crimp clips (not shown) to the bare ends of insulated wires W-3 and W-4, respectively. Universal connector element 15 includes a molded plastic insulated housing 20 which, in a preferred embodiment, is rectangular in cross-section and has a stop member or flange 21 beyond which the male prong elements 16, 17 project. As noted earlier, the male prong elements may be on connector element 2-10 as opposed to the connector element 15. As shown, the connector element 15 is universal in that it is common to all three embodiments shown in FIGS. 2, 8 and 14.

Figure 5:
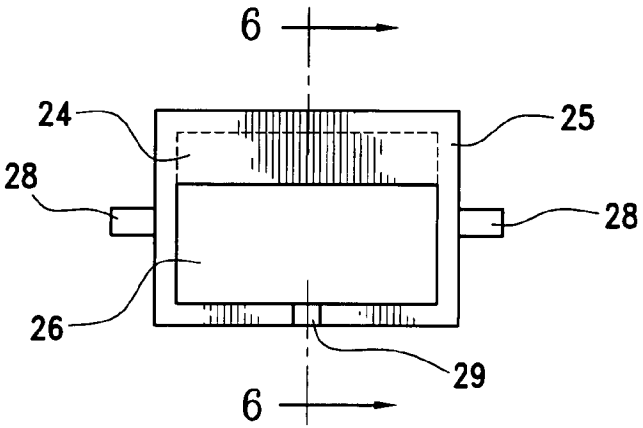
FIGS. 5, 6 and 7 are end, sectional and top views of the complemental latching member.

The third component of the connector system disclosed in FIG. 2 is a complemental connector latch member CLM (shown in greater detail in FIGS. 5, 6 and 7) which, in this embodiment is a hollow body member 23 which is generally tubular in configuration and has a closed end stop wall 24. Closed end stop wall 24 has an aperture or opening 26 that conforms in shape and size to the cross-sectional area of end 25 of the universal connector element 15. The cross-section of the internal cavity IC is the complement of the cross-section of the flange or stop end 21 on the universal connector part 15.

Figure 6:
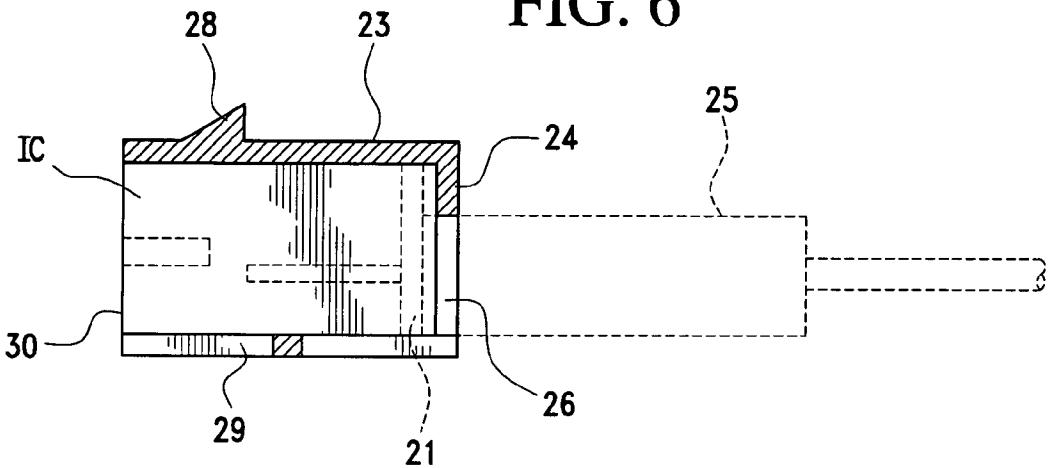
Figure 7:
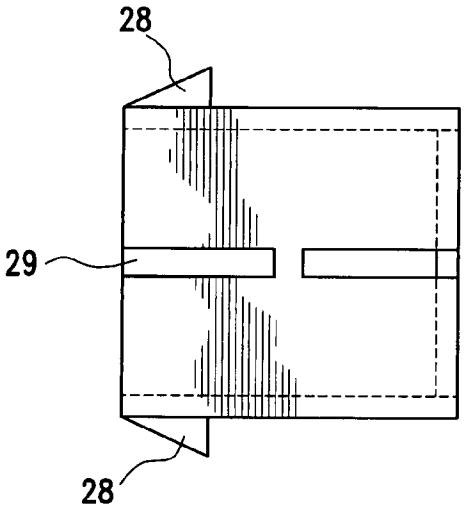

In FIG. 6, a sectional view of the complemental connector latch member CLM-2 is shown and the opening 26 in wall 24 is shown as having its cross-section adapted for a sliding, telescoping fit over the end 25 of the connector element 15. Complementary connector latch member 23 has a plurality of latching barbs 28 on the sides thereof and a groove 29 on the bottom side thereof. Some O.E.M. electrical connectors are provided with an orientation rib which groove 29 slides along. The cross-sectional area of the open end 30 of complemental member connector latch CLM-23 is adapted to snugly fit round the end flange 21 of the male connector element 15. At the same time, the stop wall end 24 above opening 26 is adapted to engage the flange 21.

Referring now to FIG. 3, the universal male connector element 15, with its outwardly projecting conductive male prong elements 16, 17 is shown plugged into the female sockets in connector element 2-10. Then, as shown in FIG. 4, the complemental connector latching member CLM-23 is telescoped over the outwardly protruding end 25 of the male conductor element 15. A barb 28 cams the latch element LE up until the barb passes the latch position, thereby avoiding disconnection. The housing 23 shields any exposed electrical members in the O.E.M. connector 2-10.

Referring now to FIG. 4, the complemental connector latch member CLM-23 is shown as in its seated position with end 20 of the connector component 15 projecting outwardly. The leading edge of latching barb 28 has cammed the locking clip LE-2 up and seated itself in latching relation with respect thereto. The groove 29 is fitted on an orientation rib (not shown) on female connector component 2-10. The additional barbs permit the complemental latching member CLM to be used with other types of O.E.M. connectors (see FIGS. 14-16).

Figure 12:
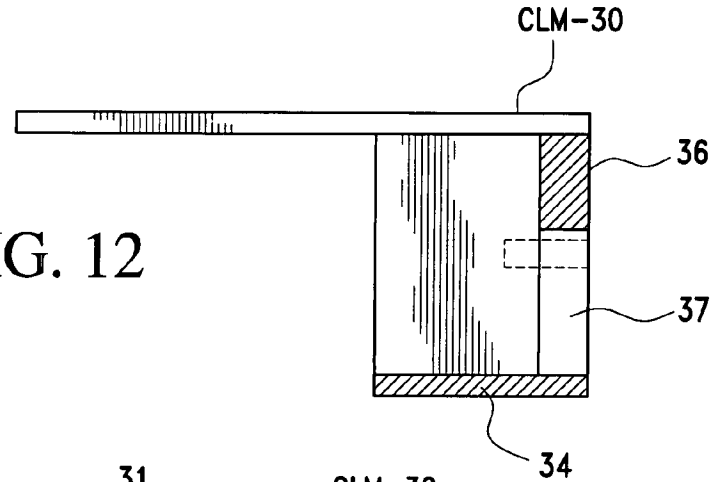
Figure 13:
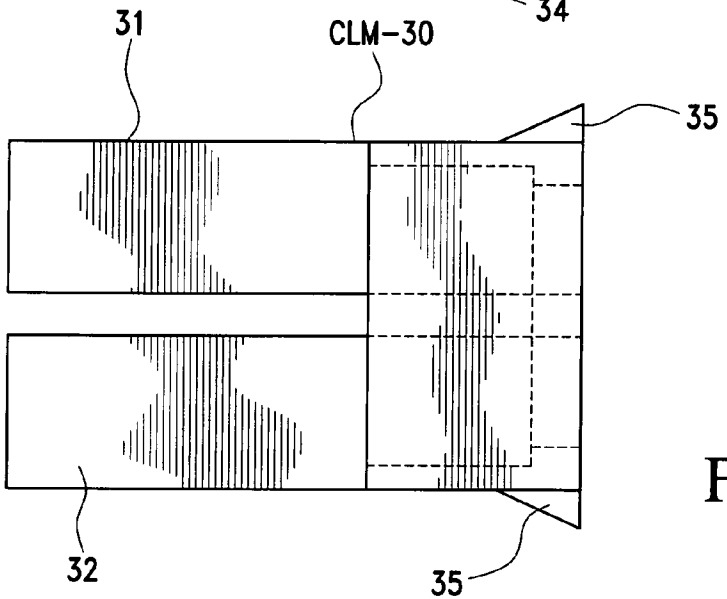

Referring to FIGS. 8-10, the O.E.M. connector component 8-10 is known in the art and supplied, typically by car manufacturers, as original equipment. The universal male connector element 15' is identical in construction to that described in connection with FIG. 2 and is likewise provided with two wires W-3, W-4. The complemental latching member CLM-30 (FIGS. 12, 13 and 14) in this case is preferably a plastic molding having a pair of forwardly projecting cover members 31, 32 and a generally rectangular housing 34 having a rear end 36 with an opening 37 similar to the opening shown in FIGS. 5, 6 and 7. The complemental latch member CLM-30 has locking barbs 35 (there may be other locking barbs not shown). The forwardly projecting members 31, 32 are spaced apart a distance corresponding to the orientation rib OR-40 and protect exposed electrical components EC in O.E.M. connector part S-10 (see FIG. 10). In use, the universal male connector component 15' has its outwardly projecting male conductor elements 16', 17' plugged into the female socket members of plug 8-10 as shown in FIG. 9. Then the complemental latch member CLM-30 is telescoped over the body of the universal male connector element 15' in the same fashion as in FIGS. 2-4. Then the complemental latch member CLM-30 is telescoped over the end of the male connector element, and the guide or orientation rib OR-40 slides between the two spaced-apart projection members 31, 32 until the latching barb 35 has its leading edge cam the latch member on the existing socket element and seats therebehind, wall 35 abuts locking flange 21' of the universal element 15'.

Figure 15:
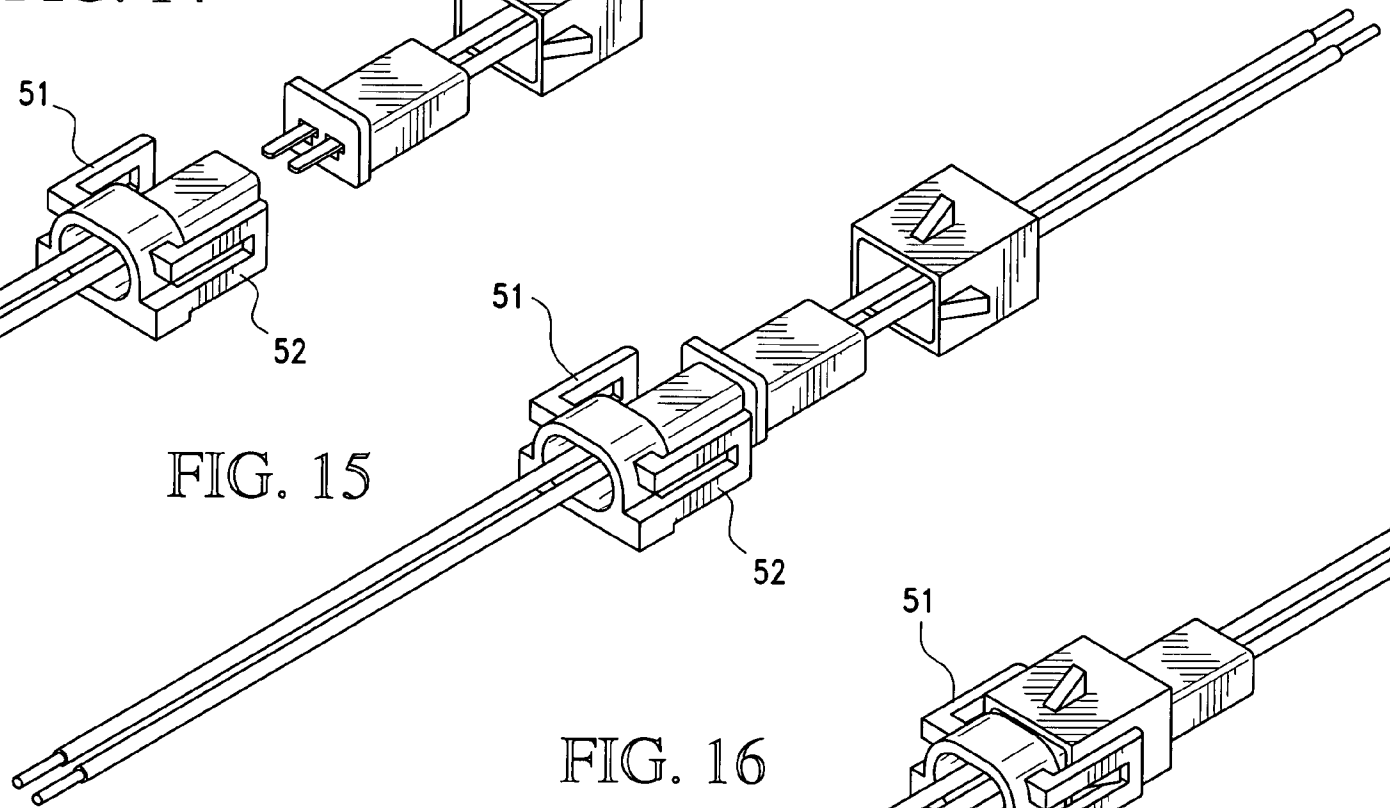
FIG. 15 is an exploded view of a partially assembled connector of the third embodiment.
Figure 16:
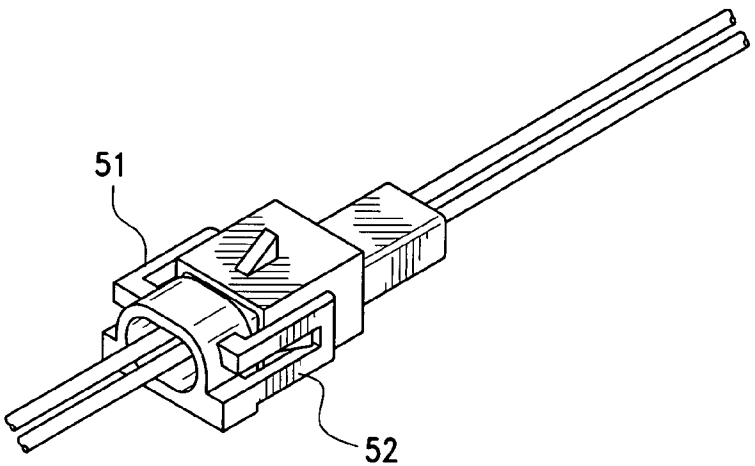
FIG. 16 is a fully assembled view of the third embodiment of the invention.

In the embodiment shown in FIGS. 14-16, the O.E.M. connector element 14-10 (FIG. 1) is provided with side latching elements 51, 52. Universal male plug 15 is plugged into the female sockets (not shown), and the complemental latch member shown in FIGS. 2-4 is utilized. In this case, the leading edges of barbs 28 cam the latching elements 51, 52 on the female socket 14-10 outwardly and latch therebehind.

Thus, the invention provides a system for providing universal connectivity to existing electrical connectors.

While the invention has been described in relation to preferred embodiments of the invention, it will be appreciated that other embodiments, adaptations and modifications of the invention will be apparent to those skilled in the art.

What is claimed is:

1. An electrical connector system comprising a universal electrical connector part adapted to be universally applicable to a wide variety of many different types of electrical connectors, and a discrete complementary latching member adapted to fit over and maintain an electrical connection, said complementary latching member having a locking abutment and adapted to telescope over said universal electrical connector to coact with a given existing connector having orientation key elements in selected locations and latch said universal electrical connector part in mating relation with said existing electrical connector, such that said discrete complementary latching member telescopes over said universal electrical connector part and has a latching or locking wall which coact with a locking abutment on the universal part to maintain the electrical connection.

2. An adaptable universal electric connector system comprising a first electrical connector part, said first electrical connector part being adapted to be universally applicable to a wide variety of original equipment manufacturer (O.E.M.) electrical connectors having a variety of latch element shapes and locations thereon, a complementary latching member having a hollow body member and an end which telescopes over said first electrical connector part and coacts with the said O.E.M. electrical connector part, said complementary latching member having one or more latch elements with shapes and orientations in particular locations to thereby maintain said electrical connector part in mating relation with said O.E.M. electrical connector.

3. The invention defined in claim 2 wherein the complementary latching member has an internal cavity designed to fit male O.E.M. electrical connector so as to not allow any conductive male connector element of the O.E.M. electrical connector to contact any part of the environment that it is not supposed to thereby removing the chance of shorting the electrical system.

4. The invention defined in claim 2 wherein the complementary latching member has an internal cavity designed to fit male O.E.M. electrical connector so as to not allow rotation of the connection thereby avoiding possible disconnection of the first connector part by twisting of the connection.

5. An adaptable universal electric connector system comprising a first electrical connector part, said first electrical connector part being adapted to be universally applicable to a wide variety of existing electrical connectors having a variety of latch element shapes and locations thereon, a complementary latching member having a hollow body and an end which telescopes over said first electrical connector part and coacts with the said existing electrical connector part, one or more latch elements on said complementary latching member having a shape and orientation in particular locations to thereby maintain said first electrical connector part in mating relation with said existing electrical connector.

* * * * *